US007143466B2

(12) United States Patent
Kess

(10) Patent No.: US 7,143,466 B2
(45) Date of Patent: Dec. 5, 2006

(54) RECEPTACLE FOR VACUUM CLEANER ACCESSORIES

(75) Inventor: Herbert Kess, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 108 days.

(21) Appl. No.: 10/745,279

(22) Filed: Dec. 22, 2003

(65) Prior Publication Data

US 2004/0134017 A1 Jul. 15, 2004

Related U.S. Application Data

(63) Continuation of application No. PCT/EP02/06461, filed on Jun. 12, 2002.

(30) Foreign Application Priority Data

Jun. 22, 2001 (DE) ..... 101 30 331

(51) Int. Cl.
*A47L 5/00* (2006.01)
*A47L 9/00* (2006.01)

(52) U.S. Cl. ..... 15/323

(58) Field of Classification Search ..... 15/323, 15/414

See application file for complete search history.

(56) References Cited

U.S. PATENT DOCUMENTS 4,720,890 A 1/1988 Jacob
5,732,438 A * 3/1998 Tuvin et al. ..... 15/323
6,286,182 B1 * 9/2001 Mulder et al. ..... 15/323
2003/0217433 A1 * 11/2003 Albert et al. ..... 15/410

FOREIGN PATENT DOCUMENTS

| | | | |
|---|---|---|---|
| DE | 81 19 955.4 U1 | | 6/1982 |
| DE | 101 08 639 A1 | | 9/2002 |
| EP | 0 304 963 A1 | | 3/1989 |
| EP | 0 747 000 | * | 12/1996 |
| EP | 0 747 000 B1 | | 12/1996 |
| GB | 2 388 526 | * | 11/2003 |
| JP | 11-99099 | * | 4/1999 |
| JP | 11-318775 | * | 11/1999 |
| JP | 2000051124 A | | 2/2000 |
| JP | 2000-70188 | * | 3/2000 |
| KR | 2003- 059666 | * | 7/2003 |
| WO | 00/47101 | | 8/2000 |

* cited by examiner

*Primary Examiner*—Terrence R. Till
(74) *Attorney, Agent, or Firm*—Craig J. Loest; Russell W. Warnock

(57) ABSTRACT

A clip- or sheath-type holder includes a partial plug-in part and a snap-on part for housing a combination of small parts or individual accessories for the vacuum cleaner. The holder is permanently fixed to the bow of a tubular handle such that the user has all the accessories at hand and can easily interchange the accessories. The combination of accessories is inserted into the housing body on one side and is snapped into place by a pivoting motion such that it is fixed on all sides.

10 Claims, 1 Drawing Sheet

RECEPTACLE FOR VACUUM CLEANER ACCESSORIES

CROSS-REFERENCE TO RELATED APPLICATION

This application is a continuation of copending International Application No. PCT/EP02/06461, filed Jun. 12, 2002, which designated the United States and was not published in English.

BACKGROUND OF THE INVENTION

Field of the Invention

The invention relates to a device for storing accessories for a vacuum cleaner that includes a pipe handle that can be connected to a vacuum pipe and placed in contact with a vacuum cleaner and also includes a receptacle for receiving the accessories, which is connected to the pipe handle by fastening measures.

Such a device for storing accessories is already known from European Patent 0 747 000 B1, corresponding to U.S. Pat. No. 5,732,438 to Tuvin et al. Basically, with vacuum cleaners, the problem lies in the attaching of an attachment to the vacuum pipe that is adequate for the surface that is being cleaned in light of the nature of the surface. Accordingly, there exist furniture brushes, crevice cleaning nozzles, upholstery nozzles, brush attachments, and others for optimal cleaning. The problem for the user is to have all these attachment pieces in hand as quickly as possible to be able to switch easily between different cleaning surfaces. A cumbersome storage of the attachments in the vacuum cleaner housing itself should be avoided. A handle is already known from Tuvin et al. that has two pipe pieces joined at an obtuse angle at which a receptacle for the accessories can be attached. The receptacle forms such a device for storing accessories. One of the two pipe pieces is provided with a hook that corresponds to a corresponding recess at the receptacle, such that one end can be placed on the hook, while the other end of the receptacle can be clipped on by a projection that surrounds the other pipe piece over more than half its perimeter.

International Publication WO 00/47101, corresponding to U.S. Pat. No. 6,286,182 to Mulder et al., describes another receptacle for receiving appliances for a vacuum cleaner. This receptacle is also detachably connected to the pipe handle, this being achieved with the aid of a connecting element that is attached to the receptacle. The connecting element extends substantially parallel to the pipe handle and includes a rear part with an arc shape that is nestled against the inner perimeter of the pipe handle.

SUMMARY OF THE INVENTION

It is accordingly an object of the invention to provide a receptacle for vacuum cleaner accessories that overcomes the hereinafore-mentioned disadvantages of the heretofore-known devices of this general type and that guarantees a simple and cost-effective accommodation of accessories.

With the foregoing and other objects in view, there is provided, in accordance with the invention, a vacuum cleaner accessory storing device, including a pipe handle to be connected to a vacuum pipe of a vacuum cleaner and placed in engagement with the vacuum cleaner, the pipe handle having a side and a receptacle for receiving vacuum cleaner accessories, the receptacle being fixedly connected to the pipe handle at least on the side.

According to the invention, the receptacle is connected to the pipe handle in non-detachable fashion at least on one side.

The inventive solution creates a stable and permanent connection between the receptacle and the pipe handle, which guarantees rapid and secure accommodation of the vacuum cleaner accessories. Furthermore, the risk of the receptacle being lost after it is removed from the pipe handle, which can happen to the known receptacles, does not exist.

In the inventive solution, only a small amount of material must be used for forming the receptacle. This is, nevertheless, distinguished by a high dimensional stability because it is permanently joined to the pipe handle. The forming of a free region between the pipe handle and the receptacle through which a hand is able to reach also makes possible an ergonomic use of the pipe handle, while at the same time all accessories are available to the operator in the immediate vicinity.

The receptacle is, advantageously, disposed below the pipe handle.

In accordance with another feature of the invention, the receptacle is, preferably, substantially chord-shaped, whereas the pipe handle is constructed in an arc shape. In such a case, the pipe handle and receptacle form a particularly compact configuration.

In accordance with a further feature of the invention, the receptacle is shaped like a hollow cylinder next to one of its fastenings at the pipe handle so that accessories are inserted from an externally accessible portion of the receptacle into the hollow-cylindrical region of the receptacle, whereas the accessories are held in another region of the receptacle by a wall of the receptacle that is constructed in resilient form, which surrounds the accessories over more than half their cylindrical perimeter.

In accordance with an added feature of the invention, the receptacle defines a hollow cylindrical area in a region adjoining the fastening and the hollow cylindrical area receives the accessories in at least one of a push-fit and a pivoting fit.

In accordance with an additional feature of the invention, the receptacle has a cylindrical perimeter and a side averted from the pipe handle, the side has a length, the receptacle is resilient at least in a region of the length on the side averted from the pipe handle and surrounds the accessories over more than half the cylindrical perimeter, and the receptacle receives the accessories in a snap fit.

In accordance with yet another feature of the invention, the region of the receptacle in which it is open over the majority of its perimeter is so constructed as to make possible the insertion of accessories that partly have a larger perimeter than the receptacle.

In accordance with yet a further feature of the invention, the receptacle has a perimeter and a cylindrical perimeter and the receptacle is open over more than half the cylindrical perimeter at least in one region thereof for receiving components projecting beyond at least one of the perimeter and the cylindrical perimeter.

In accordance with a concomitant feature of the invention, the receptacle is connected to the pipe handle at joints, the receptacle forms a ridge between the joints at which the receptacle is connected to the pipe handle, and at least one holder for receiving the accessories is formed at the ridge.

Other features that are considered as characteristic for the invention are set forth in the appended claims.

Although the invention is illustrated and described herein as embodied in a receptacle for vacuum cleaner accessories, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
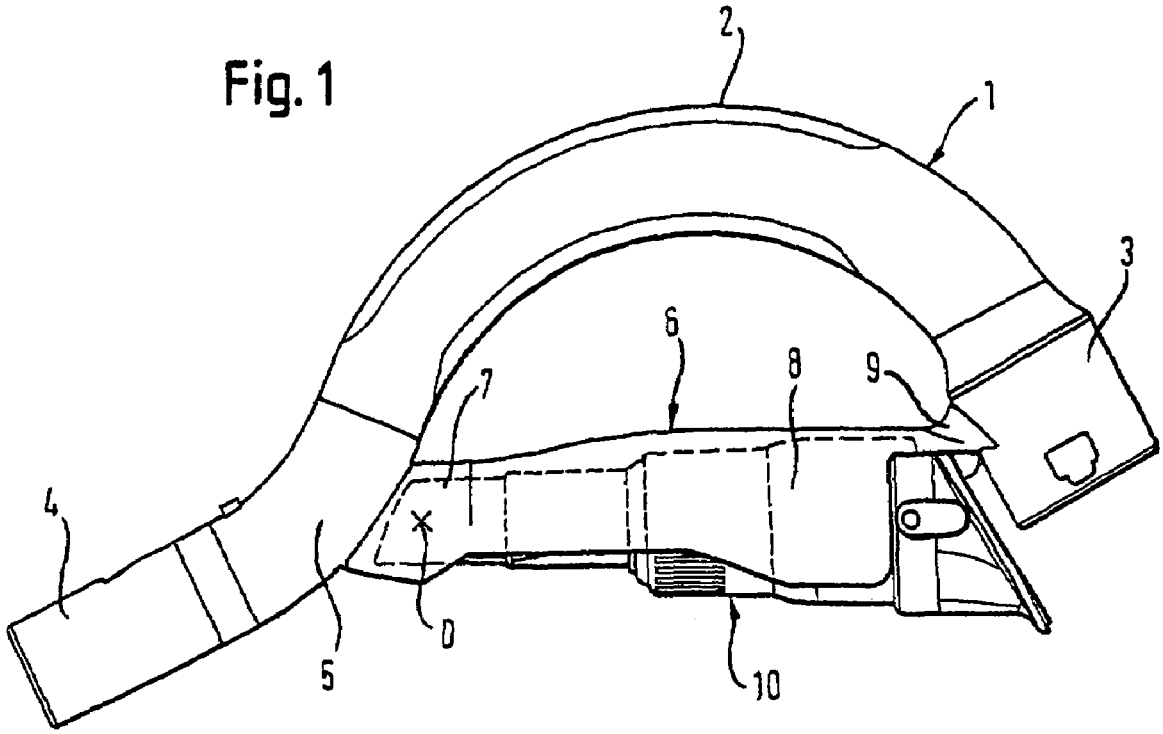
FIG. 1 is a partially hidden, side elevational view of a pipe handle according to the invention furnished with a receptacle.
Figure 2:
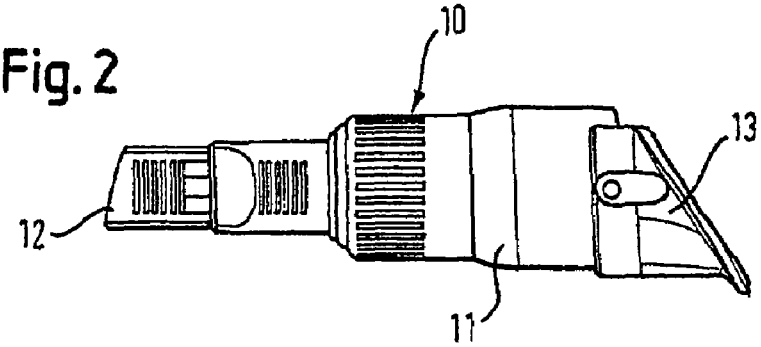
FIG. 2 is a side elevational view of a configuration according to the invention with accessories.
Figure 3:
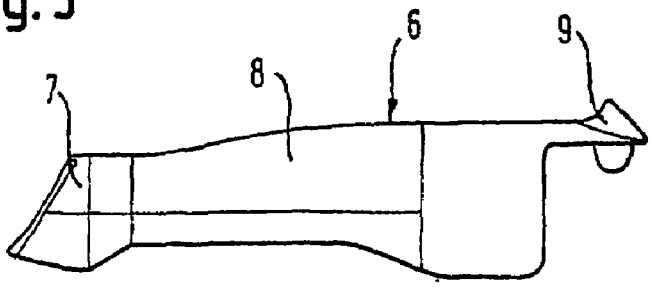
FIG. 3 is a side elevational view of a receptacle for the pipe handle of FIG. 1.

Referring now to the figures of the drawings in detail and first, particularly to FIG. 1 thereof, there is shown pipe handle 1 constructed like a pipe and curved in an arc. The handle 1 has a handle surface 2. At one end, the pipe handle 1 has a connecting collar 3 for connecting a vacuum hose, and, at the other end, the handle 1 has a connecting collar 4 for connecting a vacuum pipe. A receptacle 6 is connected in non-detachable fashion on the bottom side of a region 5 between the connecting collar 4 and the pipe handle 1. The receptacle 6 is configured substantially in the shape of a chord relative to the arc of the pipe handle 1 and extends between the region 5 and the connecting collar 3. The receptacle 6 is configured in the shape of a clip or sleeve. A pipe-shaped connecting part 7, which belongs to the receptacle 6, is provided on the pipe handle 1 next to the region 5. The connecting part 7 merges into a pipe region 8 that is open on a side averted from the pipe handle 1 so that a combination 10 of accessories (FIG. 2) can be swung into the region 5 and is at least partly accessible from below in the pipe region 8. The pipe region 8 is, advantageously, configured such that it at least partly wraps around more than half the perimeter of the combination 10 of the accessories. At least in the pipe region 8, the receptacle 6 is constructed in resilient form, such that the wall of the pipe region 8 gives when the combination 10 of accessories is swung or slid in and, after the combination 10 is inserted, holds the combination 10 by positive or non-positive engagement.

Adjacent the pipe region 8 is a region 9 that forms a connecting ridge for the collar 3. The region 9 is configured such that it is possible to surround the combination 10 of the accessories from the bottom side of the receptacle 6 so that an operator can swing the combination 10 of accessories out of the receptacle as the combination 10 rotates approximately about a pivot D (FIG. 1). In the region 9, the receptacle 6 can also receive components that extend beyond the perimeter of the receptacle 6.

In another embodiment, instead of a rotational movement, a pure transverse movement away from the pipe handle 1 can be used for removing the combination 10 from the receptacle 6, provided that the region 7 is not pipe shaped but, rather, open on the bottom side.

In another exemplifying embodiment that is not illustrated, the receptacle 6 is constructed like the region 9, i.e., substantially like a ridge, over its entire length and has at least one clip that wraps more than halfway around the perimeter of the combination 10 and holds it. Several clips can also be provided instead of only one.

In another exemplifying embodiment that is not illustrated, a bottom part that is shaped like a half-pipe is joined to a receptacle that is also shaped like a half-pipe by a hinge, which is closable by a film hinge and which receives the combination 10, for instance. In such a case, the receptacle is constructed like a ridge, for example. The bottom part either has the same length as the receptacle or is shorter. The combination 10 includes a base body 11 to which a crevice nozzle 12 and a furniture nozzle 13 or a non-illustrated furniture brush are attached. The combination 10 is known from German Published, Non-Prosecuted Patent Application DE 101 08 639 A.

Instead of the combination 10, individual vacuum cleaner attachments that are not connected to one another can also be disposed in the receptacle 6 next to or behind one another. The receptacle is, then, equipped with clips and other holding mechanisms accordingly.

The invention provides a clip shaped or sleeve shaped receptacle 6 with a partial push-in part, namely region 7, and a snap-in part, namely region 8, for receiving a combination 10 of small parts or individual appliances for the vacuum cleaner. The receptacle 6 is fastened at the curve of a pipe handle 1 so that it cannot be lost and, therefore, the user has all accessories available within reach and can easily change the accessories. The combination 10 of accessories is inserted into the receiving body of the receptacle 6 on one side and snapped in by swiveling so that it is fixed on all sides.

I claim:

1. A vacuum cleaner accessory storing device, comprising:

a pipe handle to be connected to a vacuum pipe of a vacuum cleaner and placed in engagement with the vacuum cleaner, said pipe handle having a side;

a receptacle for receiving vacuum cleaner accessories, said receptacle being fixedly connected to said pipe handle at least on said side, and said receptacle having a pivot for pivotably attaching the vacuum cleaner accessories;

said receptacle has at least one fastening to said pipe handle;

said receptacle defines a hollow cylindrical area in a region adjoining said fastening; and said hollow cylindrical area receives the accessories in a pivoting fit, the hollow cylindrical area enclosing the pivot and completely surrounding at least a portion of the accessories.

2. A vacuum cleaner accessory storing device, comprising:

a pipe handle to be connected to a vacuum pipe of a vacuum cleaner and placed in engagement with the vacuum cleaner, said pipe handle having a side; and a receptacle for receiving vacuum cleaner accessories, said receptacle being fixedly connected to said pipe handle at least on said side, and said receptacle having a pivot for pivotably attaching the vacuum cleaner accessories;

said receptacle is constructed in a shape of a hollow cylinder in a region adjoining fastenings of said receptacle at said pipe handle; and accessories being pivoted into said hollow-cylindrical shape of said receptacle, the hollow-cylindrical shape of said receptacle enclosing the pivot and completely surrounding at least a portion of the accessories.

3. A vacuum cleaner accessory storing device, comprising:

a pipe handle to be connected to a vacuum pipe of a vacuum cleaner and placed in engagement with the vacuum cleaner, said pipe handle having a side;

a receptacle for receiving vacuum cleaner accessories, said receptacle being fixedly connected to said pipe handle at least on said side, and said receptacle having a pivot for pivotably attaching the vacuum cleaner accessories;

said receptacle has a perimeter and a cylindrical perimeter; and said receptacle is open over more than half said cylindrical perimeter at least in one region thereof for receiving components projecting beyond at least one of said perimeter and said cylindrical perimeter.

4. A vacuum cleaner accessory storing device, comprising:

an arc-shaped pipe handle to be connected to a vacuum pipe of a vacuum cleaner and placed in engagement with the vacuum cleaner, said pipe handle having a side;

a receptacle for receiving vacuum cleaner accessories, said receptacle having a pivot for pivotably attaching the vacuum cleaner accessories, being permanently fixed to said pipe handle at least on said side to prevent the receptacle from being disconnected from the pipe handle and being substantially chord-shaped relative to said arc-shaped pipe handle;

said receptacle has a perimeter and a cylindrical perimeter; and said receptacle is open over more than half said cylindrical perimeter at least in one region thereof for receiving components projecting beyond at least one of said perimeter and said cylindrical perimeter.

5. The device according to claim 4 wherein:

said receptacle has at least one fastening to said pipe handle;

said receptacle defines a hollow cylindrical area in a region adjoining said fastening; and said hollow cylindrical area receives the accessories in a pivoting fit.

6. The device according to claim 4, wherein:

said receptacle has a cylindrical perimeter and a side averted from said pipe handle;

said side has a length;

said receptacle is resilient at least in a region of said length on said side averted from said pipe handle and surrounds the accessories over more than half said cylindrical perimeter; and said receptacle receives the accessories in a snap fit.

7. A vacuum cleaner accessory storing device, comprising:

an arc-shaped pipe handle to be connected to a vacuum pipe of a vacuum cleaner and placed in engagement with the vacuum cleaner, said pipe handle having a side; and a receptacle for receiving vacuum cleaner accessories, said receptacle:

being permanently fixed to said pipe handle at least on said side to prevent the receptacle from being disconnected from the pipe handle;

being substantially chord-shaped relative to said arc-shaped pipe handle;

having a pivot for pivotably attaching the vacuum cleaner accessories; and defining a hollow cylindrical area receiving the accessories in a pivoting fit, the hollow cylindrical area enclosing the pivot and completely surrounding at least a portion of the accessories.

8. The device according to claim 7, wherein:

said receptacle has a cylindrical perimeter and a side averted from said pipe handle;

said side has a length;

said receptacle is resilient at least in a region of said length on said side averted from said pipe handle and surrounds the accessories over more than half said cylindrical perimeter; and said receptacle received the accessories in a snap fit.

9. The device according to claim 7, wherein:

said receptacle has a perimeter and a cylindrical perimeter, and said receptacle is open over more than half said cylindrical perimeter at least in one region thereof for receiving components projecting beyond at least one of said perimeter and said cylindrical perimeter.

10. The device according to claim 7, wherein:

said receptacle is connected to said pipe handle at joints;

said receptacle forms a ridge between said joints at which said receptacle is connected to said pipe handle; and at least one holder for receiving the accessories is formed at said ridge.

* * * * *